US007395924B2

(12) United States Patent
Tambo

(10) Patent No.: US 7,395,924 B2
(45) Date of Patent: Jul. 8, 2008

(54) HINGE-LID TYPE PACKAGE FOR ROD-LIKE SMOKING ARTICLES AND A BLANK THEREFOR

(75) Inventor: Hitoshi Tambo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 11/455,101

(22) Filed: Jun. 19, 2006

(65) Prior Publication Data

US 2006/0231431 A1 Oct. 19, 2006

(51) Int. Cl.
*B65D 85/10* (2006.01)

(52) U.S. Cl. ..... 206/268; 206/273; 229/160.1

(58) Field of Classification Search ..... 206/242, 206/256, 258, 264, 265, 268, 271, 273; 229/87.13, 229/160.1
See application file for complete search history.

(56) References Cited

U.S. PATENT DOCUMENTS

| | | | | |
|---|---|---|---|---|
| 2,963,214 | A | 12/1960 | Leone et al. | |
| 2,964,231 | A * | 12/1960 | Hanselman, Jr. et al. | 206/264 |
| 3,078,030 | A | 2/1963 | Gorton | |
| 3,438,564 | A | 4/1969 | Moreton | |
| 3,948,389 | A | 4/1976 | Molins et al. | |
| 4,466,536 | A * | 8/1984 | Zeitel | 206/273 |
| 4,732,276 | A | 3/1988 | Knecht et al. | |
| 4,942,961 | A * | 7/1990 | Focke et al. | 229/160.1 |
| 5,143,213 | A * | 9/1992 | Moore et al. | 206/273 |
| 5,553,773 | A | 9/1996 | Focke et al. | |
| 5,634,556 | A * | 6/1997 | Focke et al. | 206/268 |
| 6,334,532 | B1 | 1/2002 | Tambo et al. | |
| 2006/0054518 | A1 * | 3/2006 | Focke et al. | 206/273 |

FOREIGN PATENT DOCUMENTS

| | | | |
|---|---|---|---|
| EP | 0203503 | A3 | 12/1986 |
| GB | 2106869 | A | 4/1983 |
| JP | 7-300169 | A | 11/1995 |
| JP | 8-58777 | A | 3/1996 |
| RU | 2 203 638 | C1 | 11/1994 |
| RU | 19823 | U1 | 10/2001 |
| RU | 2203206 | C2 | 4/2003 |
| TW | 358792 | | 5/1999 |

* cited by examiner

*Primary Examiner*—Luan K Bui
(74) *Attorney, Agent, or Firm*—Birch, Stewart, Kolasch & Birch, LLP

(57) ABSTRACT

A hinge-lid type package for filter cigarettes is formed as a rectangular parallelepiped and includes an inner pack 36 of a cigarette bundle and a casing formed from a blank 50 as one sheet and accommodates the inner pack 36. The casing can be divided into an outer body 10 and a lid 12 by means of a separating line 14. When detached from the outer body 10 along the separating line 14, the lid 12 is rotated around a self hinge 16 to open or close.

8 Claims, 12 Drawing Sheets

HINGE-LID TYPE PACKAGE FOR ROD-LIKE SMOKING ARTICLES AND A BLANK THEREFOR

TECHNICAL FIELD

The present invention relates to a hinge-lid type package for rod-like smoking articles, such as cigarettes and filter cigarettes, and a blank thereof.

BACKGROUND ART

For instance, a hinge-lid type package of this kind is disclosed in Unexamined Japanese Patent Publication No. 8-58777. This well-known package includes a box-shaped outer body having an opening end at the upper end thereof. The outer body accommodates an inner pack in the inside, and the inner pack has a cigarette bundle of cigarettes or filter cigarettes or the like and an inner wrapper for wrapping the cigarette bundle.

The opening end of the outer body is provided with a box-shaped lid at the rear edge thereof through a hinge. The lid is rotated around the hinge and allows the opening end to open and close. More specifically, the package includes an inner frame between the outer body and the inner pack. The inner frame has a U-shaped cross section that surrounds the inner pack and reinforces the opening end of the outer body. The inner frame has an upper end portion protruding from the opening end of the outer body, and the upper end portion guides the opening and closing of the lid.

The package is further wrapped in a transparent film with a tear tape. Such film wrapper is useful for preventing the inner pack from being tampered.

As mentioned above, since the cigarette bundle is triply wrapped in the inner wrapper, the outer body and the film, the cigarette bundle is excessively wrapped. Therefore, the manufacture of packages of this kind not only consumes a large quantity of wrapper resources for cigarette bundles but also requires three wrapping steps to pack the bundle. Consequently, the packaging equipment for packages costs a great deal.

The tear tape of a film wrapper has a free end, or a pull end. Such a pull end helps opening the film wrapper, but on the other hand is deformed as it is in a free state, thereby easily curling up from the package.

For this reason, in a case that a vending machine is used for dispensing the packages, the pull end of the tear tape is liable to get caught on a dispensing guide or the like for the packages in the vending machine. Such a catch could cause a trouble in the dispensing of the package from the vending machine. When the environment around the packages is high in both temperature and humidity, the pull end of the tear tape is prone to curl up from the package, which frequently incurs the above-mentioned trouble.

DISCLOSURE OF THE INVENTION

An object of the present invention is to provide a hinge-lid type package for rod-like smoking articles and a blank therefor, the package being provided with effective countermeasures against tampering without film wrapper and being therefore suitable for saving wrapper resources.

To accomplish the above object, the hinge-lid type package for rod-like smoking articles of the present invention comprises an inner pack having an inner wrapper in which a bundle of the rod-like smoking articles is wrapped and a rectangular parallelepiped casing for accommodating the inner pack. The casing includes a front wall, a rear wall, two side walls, a bottom wall, a top wall, a hinge formed in an upper portion of the rear wall, extending across the rear wall and having both ends, a separating line extending across the front wall and both the side walls and connecting both the ends of the hinge, the separating line which allows the casing to be divided into an outer body and a lid that is rotatable around the hinge, and an inner frame disposed in the inside of the outer body to guide opening and closing of the lid.

With the above-described package, when broken along the separating line, the casing is divided into the outer body and the lid. Once the casing is broken along the separating line, breaking traces of the separating line are left in both the outer body and the lid. The breaking traces effectively function as a countermeasure against tampering on the inner pack, namely rod-like smoking articles. Therefore, the package of this invention does not require film wrapper with a tear tape, thus avoiding over-wrapping of the rod-like smoking articles.

Specifically, both the side walls of the casing each have an inner side wall layer and an outer side wall layer. The separating line includes a front portion formed in the front wall and a side portion formed in each side wall. The side portion includes a slot formed in the inner side wall layer to divide the inner side wall and a row of perforations formed in the outer side wall layer and overlapping with the slot.

In this case, each inner side wall layer is completely separated by the slot beforehand, so that the separating line can be broken without difficulty.

It is possible, however, to form each slot with a fragile portion left in the inner side wall layer. In this case, the each fragile portion is broken the moment the lid is opened for the first time.

Furthermore, the front wall includes a portion for forming the lid, the portion has an inner front wall layer and an outer front wall layer. The separating line may further include a frame perforation row for connecting between the inner frame and the inner front wall layer before the lid is first opened. According to this package, upon the initial opening of the lid, the inner frame is detached from the inner front wall layer along the frame perforation row.

A blank for producing the package comprises a rectangular rear panel having an upper edge, both side edges, a lower edge, and a folding line for forming the hinge; a bottom panel connected to the lower edge of the rear panel with the lower edge used as a folding line and having a lower edge on the opposite side of the rear panel; a front panel connected to the lower edge of the bottom panel with the lower edge used as a folding line, including both side edges, and having the same size as the rear panel; two inner side flaps connected to the respective side edges of the rear panel with both the side edges used as folding lines and having the same length as the rear panel; two outer side flaps connected to the respective side edges of the front panel with both the side edges used as folding lines and having the same length as the front panel; a top panel connected to the upper edge of the rear panel with the upper edge used as a folding line and having an upper edge; an inner top flap connected to the upper edge of the top panel with the upper edge used as a folding line; and a separating line formed in the front panel, the inner side flap and the outer side flaps, for dividing the package into the outer body and the lid that is rotatable around the hinge after the package is formed from the blank.

The separating line includes a front portion formed in the front panel, a side portion formed in each of the outer side flaps, and a slot formed in each of the inner side flaps.

The slot either extends from the rear panel up to an outer edge of the inner side flap or is formed with a fragile portion left in between the slot and the outer edge of the inner side flap.

The blank may further include a sub blank connected to the inner top flap across the frame perforation row, for forming the inner frame in the inside of the package.

Other characteristics of the invention will be disclosed in preferred embodiments explained with reference to the attached drawings.

BEST MODE OF CARRYING OUT THE INVENTION

Figure 1:
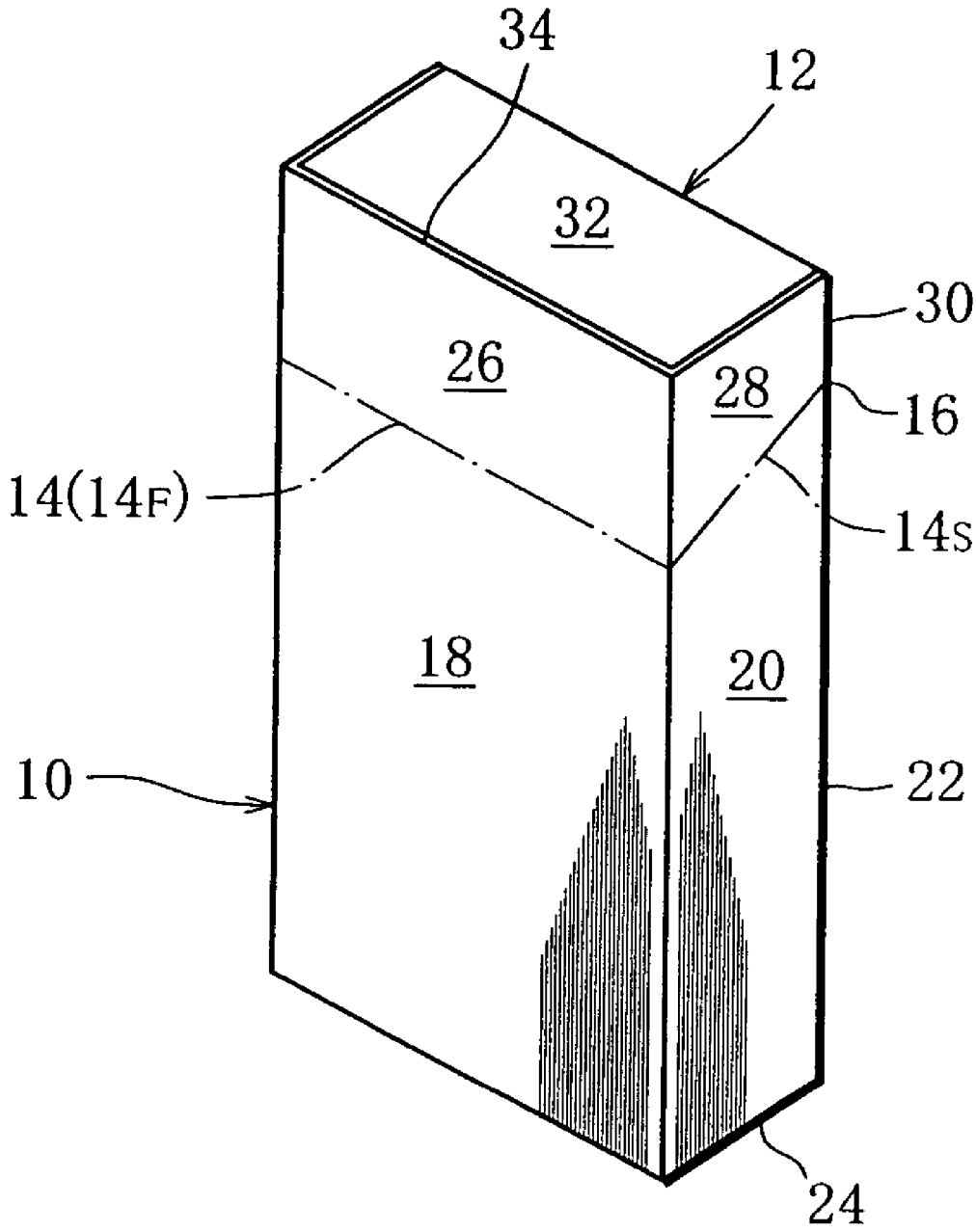
FIG. 1 is a perspective view showing a hinge-lid type package of a first embodiment.

Referring to FIG. 1, a hinge-lid type package of a first embodiment is formed as a rectangular parallelepiped, namely a box, and includes an outer body 10 and a lid 12. The lid 12 is connected to the outer body 10 so as to be detachable from a separating line 14 and is at the same time connected to an upper edge of a rear wall of the outer body 10 through a self hinge 16. In FIG. 1, the separating line 14 is shown by a dashed line and is formed of for example perforations. Adjacent perforations are either uniform in length or different in length from one another along the separating line 14.

The outer body 10 has a front wall 18, two side walls 20, a rear wall 22 and a bottom wall 24. The lid 12 also has a front wall 26, two side walls 28, a rear wall 30 and a top wall 32. As is apparent from FIG. 1, the separating line 14 includes a front segment $\mathbf{14}_F$ that separably couples the front walls 18 and 26 and side segments $\mathbf{14}_S$ that separably couple the respective side walls 20 and 28.

More specifically, the front segment $\mathbf{14}_F$ is positioned lower than the self hinge 16, that is to say, on the bottom wall 24 side of the outer box 10 to extend parallel with the self hinge 16. Each of the side segments $\mathbf{14}_S$ extends between a corresponding end of the front segment $\mathbf{14}_F$ and a corresponding end of the self hinge 16, to thereby connect these ends of the front segment $\mathbf{14}_F$ and the self hinge 16. Accordingly, each of the side segments $\mathbf{14}_S$ extends downwardly from the self hinge 16 toward the front segment $\mathbf{14}_F$.

As is obvious from FIG. 1, the lid 12 has a seam 34 between the front wall 26 and the top wall 32, the seam 34 being formed of an upper edge of the front wall 26 and a front edge of the top wall 32 located adjacent to each other.

In a case that an ordinary hinge-lid type package and the package shown in FIG. 1 are compared to each other in terms of appearance, the package shown in FIG. 1 differs from the ordinary one in the following points i) and ii).

i) The package shown in FIG. 1 includes no film wrapper.

ii) The package shown in FIG. 1 has the separating line 14 and the seam 34.

In the case of the ordinary package, an outer body and a lid thereof each have an opening edge. The opening edges are met to each other when the lid is in a closed position. Additionally in the case of the lid of the ordinary package, a front wall and a top wall of the lid are continuously connected to each other with a fold therebetween.

Figure 2:
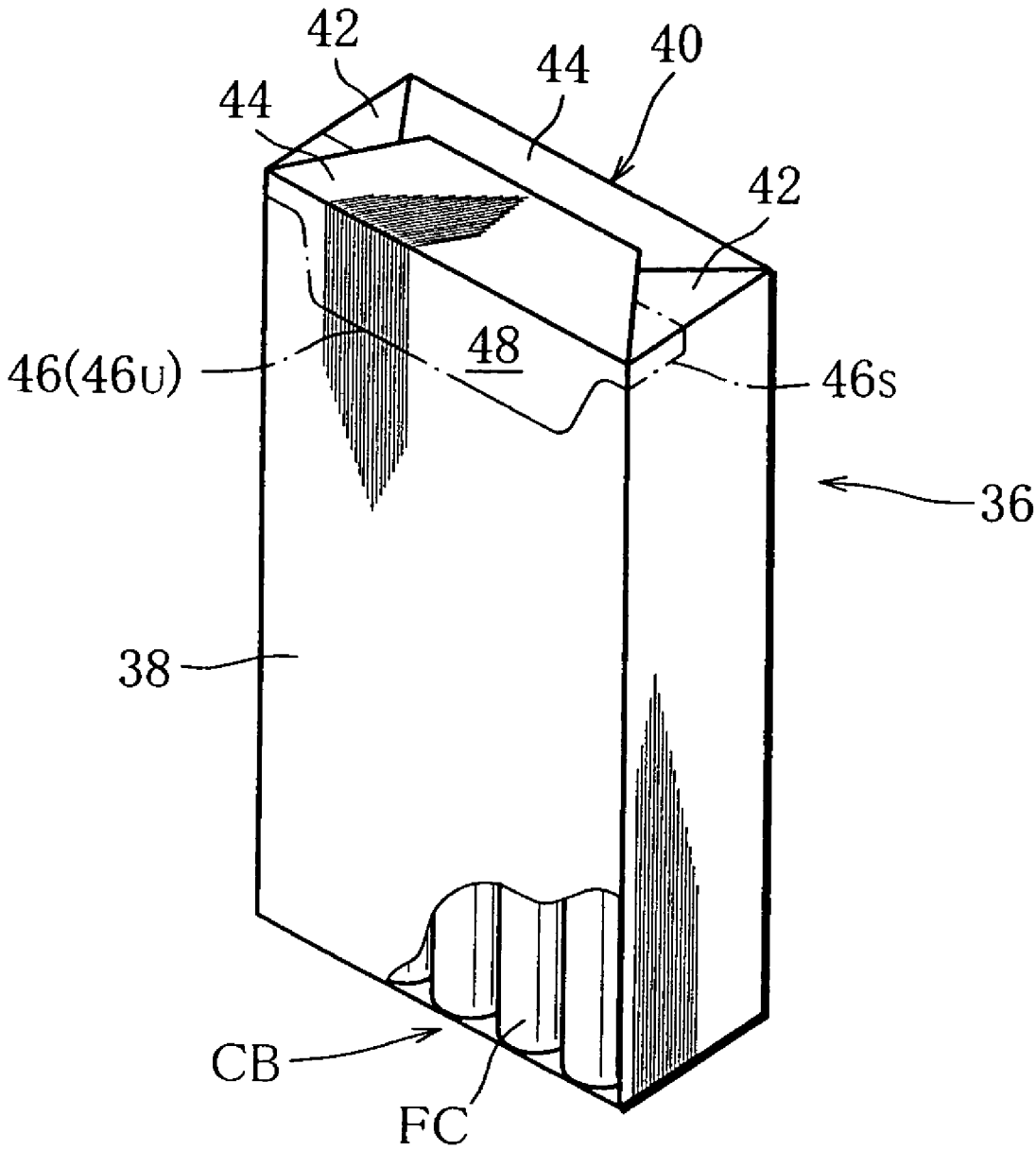
FIG. 2 is a perspective view showing an inner pack accommodated in the package of FIG. 1.

Like an ordinary package, the package shown in FIG. 1 accommodates an inner pack, which is illustrated in FIG. 2.

The inner pack 36 of FIG. 2 is formed as a rectangular parallelepiped similar to the package and includes a filter cigarette bundle CB and an inner wrapper 38 for wrapping the cigarette bundle CB. In general, the cigarette bundle CB has twenty filter cigarettes FC.

The inner wrapper 38 is made of paper and an aluminum layer deposited onto a surface of the paper. The aluminum layer of the inner wrapper 38 not only protects the cigarette bundle CB from moisture but also prevents emission of aroma from the cigarette bundle CB, or from each of the filter cigarettes FC. As the inner wrapper 38, laminated paper may be utilized in place of the aluminum-deposited paper. The laminated paper has a shield layer for preventing moisture and aroma in the inside thereof from penetrating.

The inner wrapper 38 has closure faces for closing upper and lower surfaces of the cigarette bundle, the closure faces being formed by folding a part of the inner wrapper 38. FIG. 2 shows an upper closure face 40 only. The closure face 40 includes folding sides 42 located on both sides thereof and closing flaps 44 sequentially superimposed upon the folding sides 42. The closing flaps 44 are produced simultaneously with the forming of the folding sides 42 and each have a trapezoidal shape.

The inner wrapper 38 further has a separating line 46 shown by a dashed line, the separating line 46 being formed of a row of perforations, too. More specifically, as viewed in FIG. 2, the separating line 46 includes a U-shaped portion $\mathbf{46}_U$ located in an upper portion of a front surface of the inner pack 36, a portion $\mathbf{46}_S$ extending from the right edge of the U-shaped portion $\mathbf{46}_U$ through one side face of the inner pack 36 and running through the folding side 42 of the inner pack 36 and a portion (not shown) extending the other side face of the inner pack 36 from the left edge of the U-shaped portion $\mathbf{46}_U$ up to one end edge of the inner wrapper 38. The above-described separating line 46 defines a cut-off section 48 in a part of the inner wrapper 38. The cut-off section 48 includes the upper closing flap 44 of the closure face 40.

Figure 3:
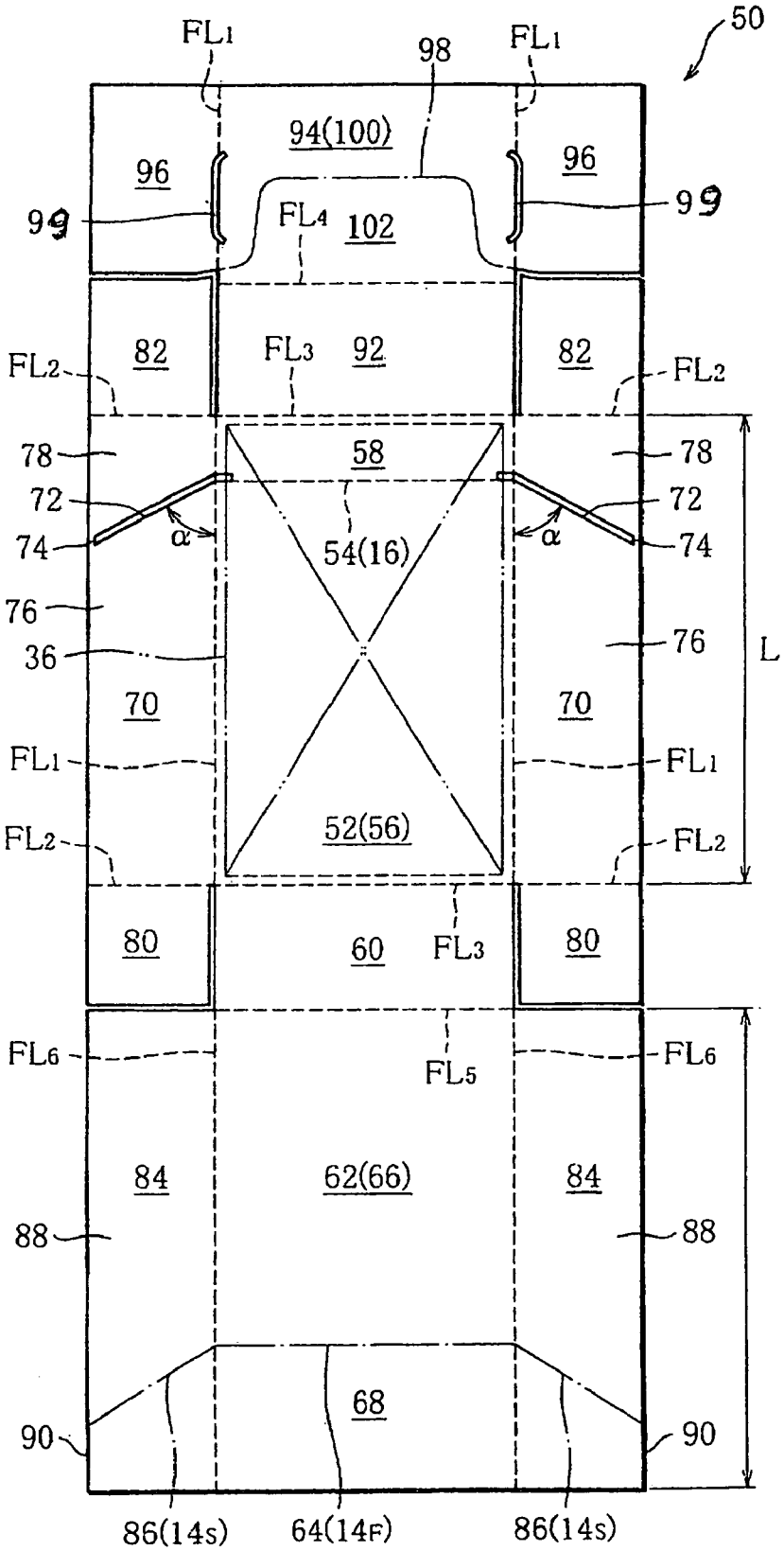
FIG. 3 is a view showing a blank for producing the package of FIG. 1.

FIG. 3 shows a reverse face of a blank 50 for forming the outer body 10 and the lid 12.

The blank 50 is formed as a rectangle and includes a rear panel 52 at the center thereof. The rear panel 52 has length L equal to the height of the package and is provided with a folding line 54. In FIG. 3, the folding line 54 is positioned in an upper portion of the rear panel 52 and extends across the rear panel 52. The folding line 54 divides the rear panel 52 into rear panel sections 56, 58 in this order from a lower side of the rear panel 52. The folding line 54 corresponds to the self hinge 16 for the lid 12, and the rear panel sections 56, 58 correspond to rear walls 22, 30 for the outer body 10 and the lid 12, respectively.

Connected to a lower end of the rear panel section 56 across a folding line $FL_3$ is a bottom panel 60, and connected to a lower end of the bottom panel 60 across a folding line $FL_5$ is a front panel 62. The front panel 62 has length L equal to the height of the package as the rear panel 52 does, and also includes a row of perforations 64. In FIG. 3, the perforations 64 is located in a lower portion of the front panel 62, thereby dividing the front panel 62 into front panel sections 66, 68 in this order from an upper side of the front panel 62. The perforations 64 corresponds to the front segment 14*F* of the separating line 14 for the package, and the front panel sections 66, 68 correspond to the front walls 18, 26 for the outer body 10 and the lid 12.

Inner side flaps 70 are connected to respective side edges of the rear panel 52 across folding lines $FL_1$, and the inner side flaps 70 each have length equal to the entire length L of the rear panel 52. Each of the inner side flaps 70 further has a slot 72, which downwardly extends from a corresponding end portion of the folding line 54 toward an outer edge of the inner side flap 70. In addition, an oblique angle of the slot 72 with respect to the folding line $FL_1$ is shown by $\alpha$ in FIG. 3.

To be more precise, the slot 72 has an inner end that defines the end portion of the folding line 54 and an outer end located close to the outer edge of the inner side flap 70. There is left a fragile portion 74 in between the outer end of the slot 72 and the outer edge of the inner side flap 70. The slot 72 then divides the inner side flap 70 into flap sections 76, 78 in this order from a lower side of the inner side flap 70. The flap sections 76, 78 are connected to each other with the fragile portion 74 located therebetween.

An inner bottom flap 80 and a top inner flap 82 are connected across folding lines $FL_2$ to the lower and upper ends of each of the inner side flap 70, respectively. The inner bottom flaps 80 are positioned on respective sides of the bottom panel 60.

Outer side flaps 84 are connected to respective side edges of the front panel 62 across folding lines $FL_6$. Each of the outer side flaps 84 has length equal to entire length L of the front panel 62 and is provided with a row of perforations 86. In FIG. 3, each of the perforations 86 is located in a lower portion of the outer side flap 84 and extends downwardly from a corresponding end of the row of perforations 64 to the outer edge of the outer side flap 84. The rows of perforations 86 are formed parallel with the respective slots 72 and correspond to the side segments $\mathbf{14}_S$ of the separating line 14.

Each of the perforations 86 divides the corresponding outer side flap 84 into flap sections 88, 90 in this order from an upper side of the outer side flap 84. When the outer side flaps 84 are turned upside down and flipped over and superimposed on the inner side flaps 70, the rows perforations 86 of the outer side flaps 84 and the slots 72 of the inner side flaps 80 overlap each other.

A top panel 92 is connected to an upper end of the rear panel 52 across the folding line $FL_3$. The top panel 92 is located in between the inner top flaps 82.

Furthermore, an inner frame panel 94 is connected to an upper end of the top panel 92 across the folding line $FL_4$. Frame side flaps 96 are connected to respective side edges of the inner frame panel 94 across the folding lines $FL_1$. The frame side flaps 96 are positioned on the upper side of the inner top flaps 82. Each of the folding lines $FL_1$ located between the inner frame panel 94 and the corresponding frame side flap 96 has a slot 99 in a part thereof, the slot 99 being arranged on the top panel 92 side.

Moreover, there is formed a separating line 98 in the inner frame panel 94. The separating line 98 is formed in the shape of an inverted U and extends across the inner frame panel 94. The separating line 98 is correspondent with the separating line 46 of the inner pack 36, and more specifically to the U-shaped portion $\mathbf{46}_U$ (see FIG. 2) of the separating line 46. The separating line 98 divides the inner frame panel 94 into a frame front section 100 and a cut-off section 102. The frame front section 100 is connected to the frame side flaps 96 across the folding lines $FL_1$, and the cut-off section 102 to the top panel 92 across the folding line $FL_4$.

A production process of the package, namely the folding procedure of the blank 50, will be described with reference to FIGS. 4 through 10.

The flaps and panels of the blank 50 are folded along the folding lines $FL_1$ through $FL_6$. The folding procedure corresponds with the numbers attached to the folding lines FL. On the reverse face of the blank 50, an adhesive agent (not shown) is preliminarily applied to prescribed places of the panels and flaps. The places to which the adhesive agent is applied will become apparent from explanations provided below.

Figure 4:
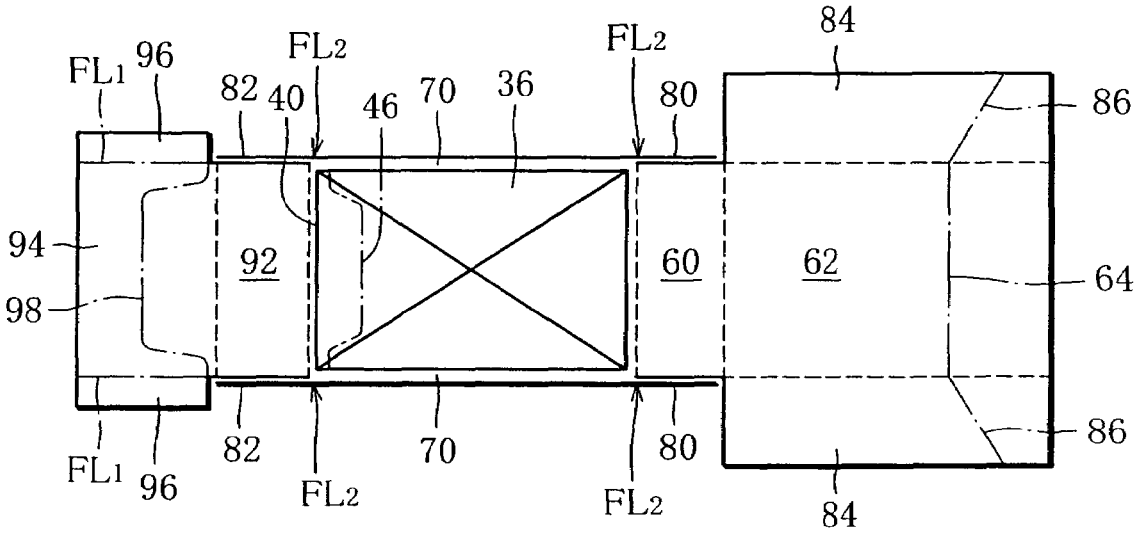
FIG. 4 is a view showing a first folding process of the blank of FIG. 3.

First, as illustrated in FIG. 4, the inner pack 36 is supplied onto the reverse face of the blank 50. The inner pack 36 is superimposed on the rear panel 52 in a state where the closure face 40 (see FIG. 2) is met with the folding line $FL_3$ of the top panel 92. At this point, the inner pack 36 is glued onto the rear panel section 56 of the rear panel 52 with the adhesive agent. As is clear from FIG. 4, the separating line 46 of the inner pack 36 faces upward, and the inner pack 36 and the blank 50 are glued to each other with the reverse faces put together. Additionally, the rear panel sections 56, 58 define the rear wall 22 of the outer body 10 and the rear wall 30 of the lid 12, respectively.

Thereafter, both the inner side flaps 70 are folded along the folding lines $FL_1$ toward the inner pack 36 to be superimposed on the respective side faces of the inner pack 36. At this point, the flap sections 76 of the inner side flaps 70 are adhered to the side faces of the inner pack 36 with the adhesive agent. The above-described folding of the inner side flaps 70 makes upright the inner bottom flaps 80 and the top inner flaps 82, so that the flaps 80, 82 are placed on virtual extended planes of the side faces of the inner pack 36.

Simultaneously with the folding of the inner side flaps 70, both the frame side flaps 96 are also preliminarily folded along the folding lines $FL_1$ toward the inner frame panel 94 side. This preliminary folding raises the frame side flaps 96 upward with respect to the inner frame panel 94.

Figure 5:
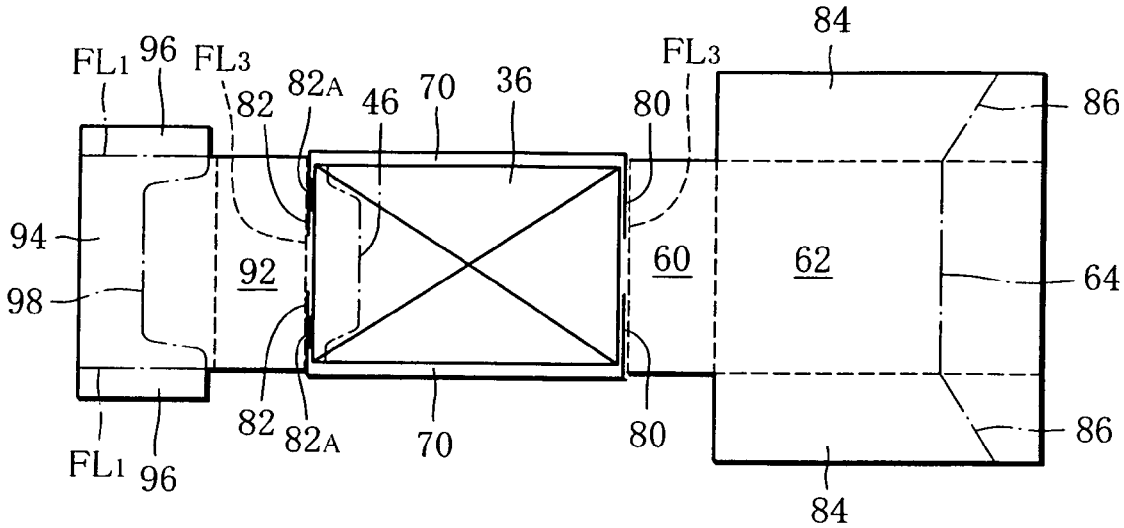
FIG. 5 is a view showing a subsequent folding process of the blank, which continues from the folded state illustrated in FIG. 4.

Subsequently, both the inner bottom flaps 80 are folded along the folding lines $FL_2$ to be superimposed on a bottom face of the inner pack 36 as illustrated in FIG. 5. While the inner bottom flaps 80 are folded, both the inner top flaps 82 are also folded along the folding lines $FL_2$. The flaps 82 are superimposed on an upper face of the inner pack 36, namely the closure face 40. At this moment, the inner top flaps 82 are glued to a part of the closure face 40, or the upper closing flap 44 (see FIG. 2) of the cut-off section 48, with the adhesive agent $\mathbf{82}_A$.

Figure 6:
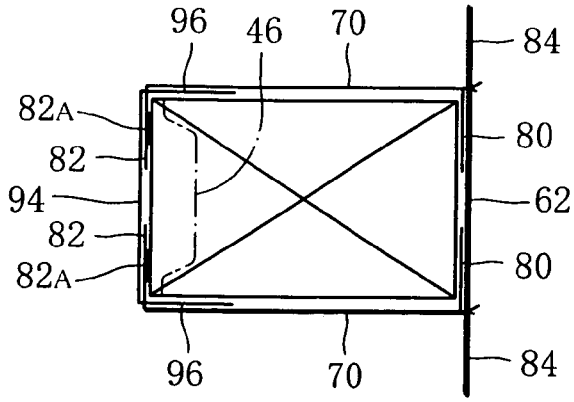
FIG. 6 is a view showing a subsequent folding process of the blank, which continues from the folded state illustrated in FIG. 5.

In the next step, the bottom panel 60 is folded along the folding line $FL_3$ toward the bottom face of the inner pack 36. As illustrated in FIG. 6, when the bottom panel 60 is superimposed on the inner bottom flaps 80, the bottom panel 60 and the inner bottom flaps 80 form the bottom wall 24 of the outer body 10. The above-described folding of the bottom panel 60 makes upright the front panel 62 with the outer side flaps 84 located on respective sides thereof.

In parallel with the folding of the bottom panel 60, the top panel 92 is also folded along the folding line $FL_3$ toward the upper face (closure face 40) of the inner pack 36. When the top panel 92 is superimposed on the inner top flaps 82, the top panel 92 and the inner top flaps 82 form the top wall 32 of the lid 12.

The above-described folding of the top panel 92 makes upright the inner frame panel 94. At the same time, both the frame side flaps 96 that have been preliminarily folded are further folded along the folding lines $FL_1$ toward each other to be positioned right above gaps G between the inner pack 36 and the inner side frame 70.

Figure 7:
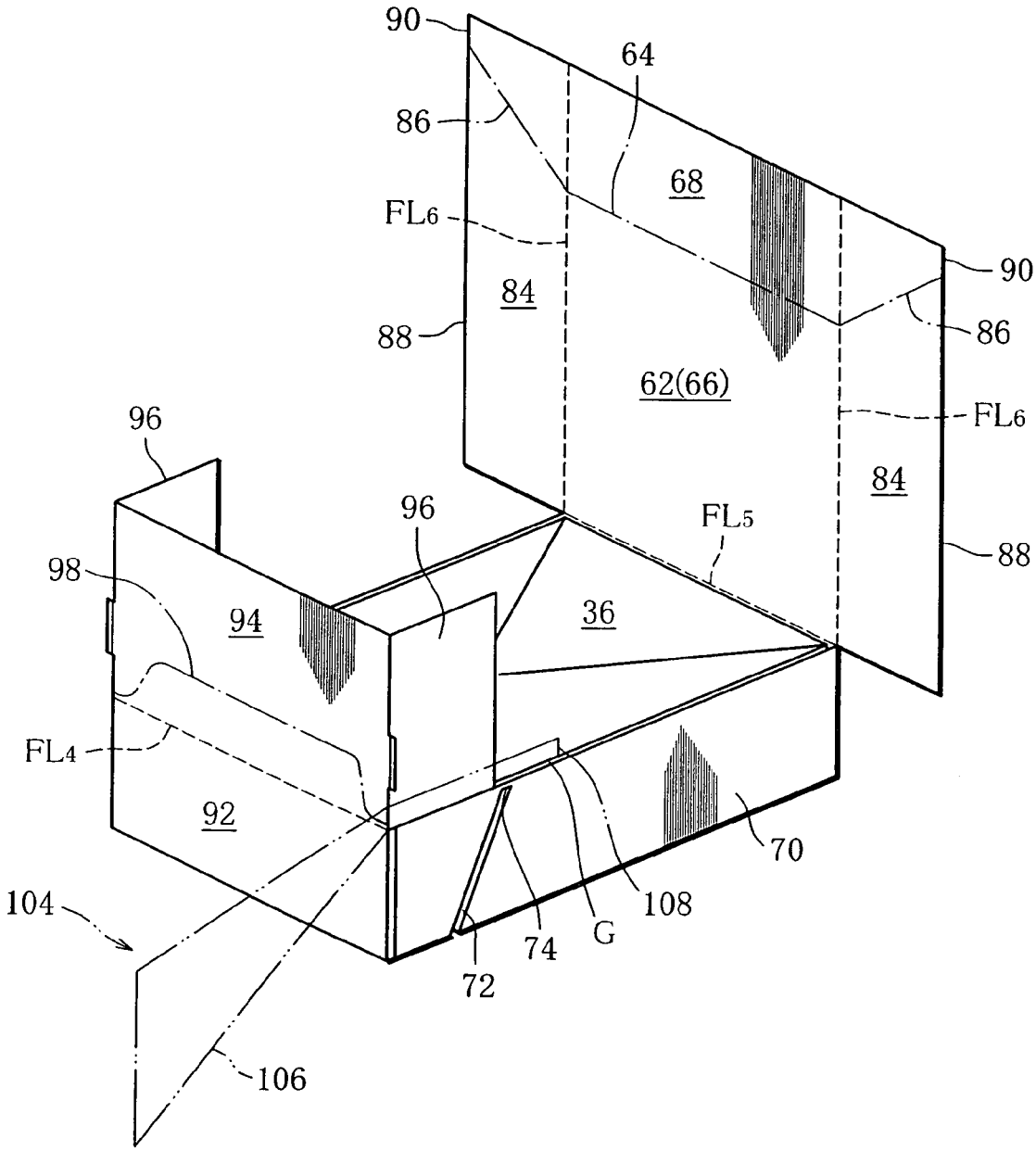
FIG. 7 is a perspective view showing the blank in the folded state illustrated in FIG. 6.

More specifically, when the top panel 92 is folded as illustrated in FIG. 7, there are disposed folding guides 104 on respective sides of the top panel 92. FIG. 7 shows one of the folding guides 104 only. The folding guides 104 are located on the corresponding sides of the frame side flaps 96 in a state before the top panel 92 is folded. Each of the folding guides 104 has a front guide portion 106 that extends to right above the corresponding inner side flap 70 as gradually approaching to the inner side flap 70 and a rear guide portion 108 that extends from the front guide portion 106 along an upper edge of the inner side flap 70. The rear guide portion 108 is provided with an insertion wedge 110 at a tip end portion thereof.

Figure 8:
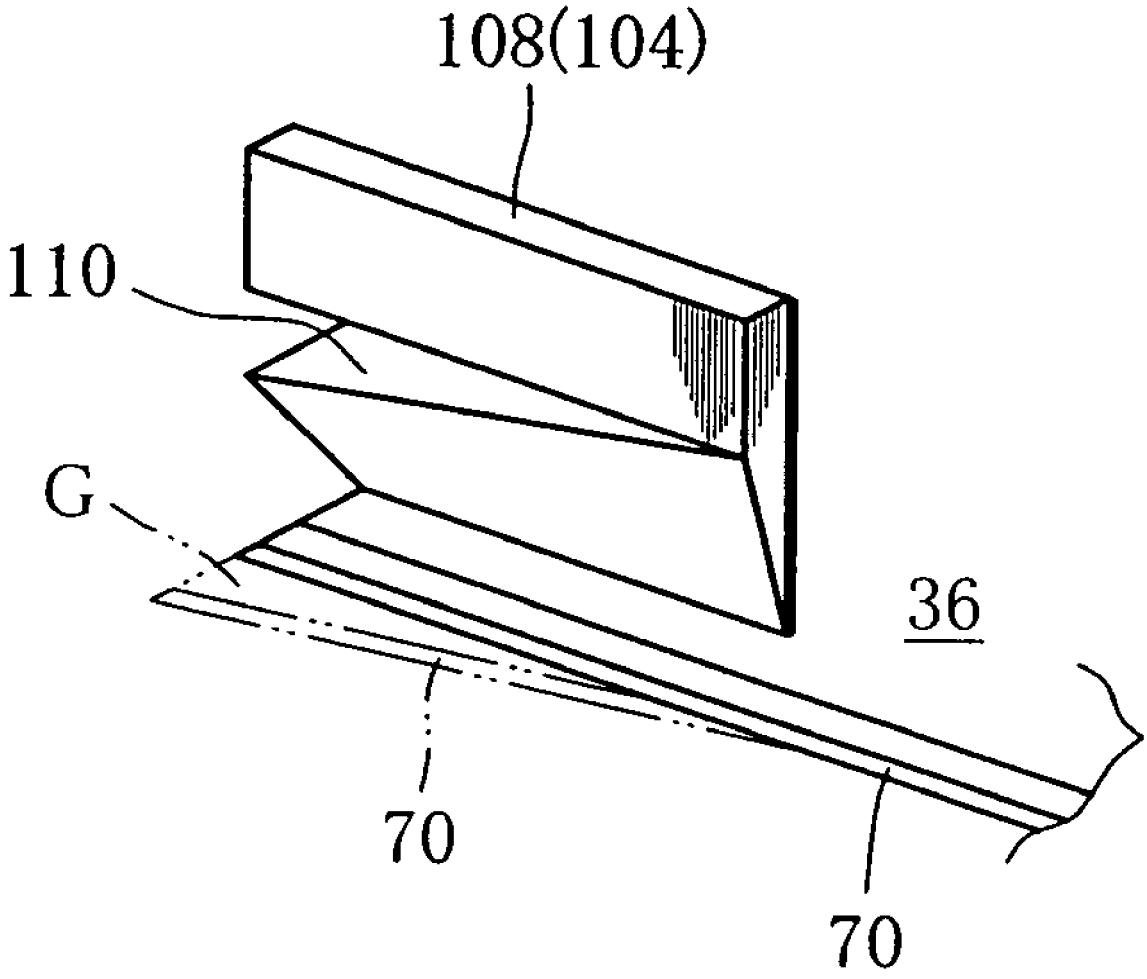
FIG. 8 is a perspective view showing a part of a folding guide used in the folding process of FIG. 7.

As illustrated in FIG. 8, the insertion wedge 110 protrudes from an outer surface of the rear guide portion 108 and is tapered toward the tip end of rear guide portion 108 and downward, respectively. When the insertion wedge 110 is inserted in between the inner pack 36 and the inner side flap 70, the upper edge of the inner side flap 70 is deformed to bend outward as shown by a chain double-dashed line in FIG. 8. By so doing, the gap G is formed in between the inner pack 36 and the inner side flap 70.

At this stage, the flap sections 76, 78 of the inner side flaps 70 are connected to each other with the fragile portions 74 therebetween, regardless of the presence of the slots 72. Therefore, the gap G is reliably secured from the insertion wedge 110 up to the upper end of the inner side flap 70, that is to say, through the upper end face (closure face 40) of the inner pack 36. Additionally, the folding guide 104 is supported to be rotatable in order to enable the insertion of the insertion wedge 110.

With the folding guide 104, when the top panel 92 is folded along the folding line $FL_3$, the inner frame panel 94 and the frame side flaps 96 rotate around the folding line $FL_3$ of the top panel 92. At this moment, the frame side flaps 96 that have been preliminarily folded are brought into contact with the respective front guide portions 106 of the folding guides 104, thereby being further folded along the folding lines $FL_1$ by the front guide portions 106. Thereafter, when the top panel 92 is superimposed on the inner top flaps 82, the frame side flaps 96 are positioned along the rear guide portions 108 of the folding guides 104 as is apparent from FIG. 7. At this point, each of the frame side flaps 96 is placed right above the gap G formed by the insertion wedge 110 in an orthogonal state to the inner frame panel 94.

Figure 9:
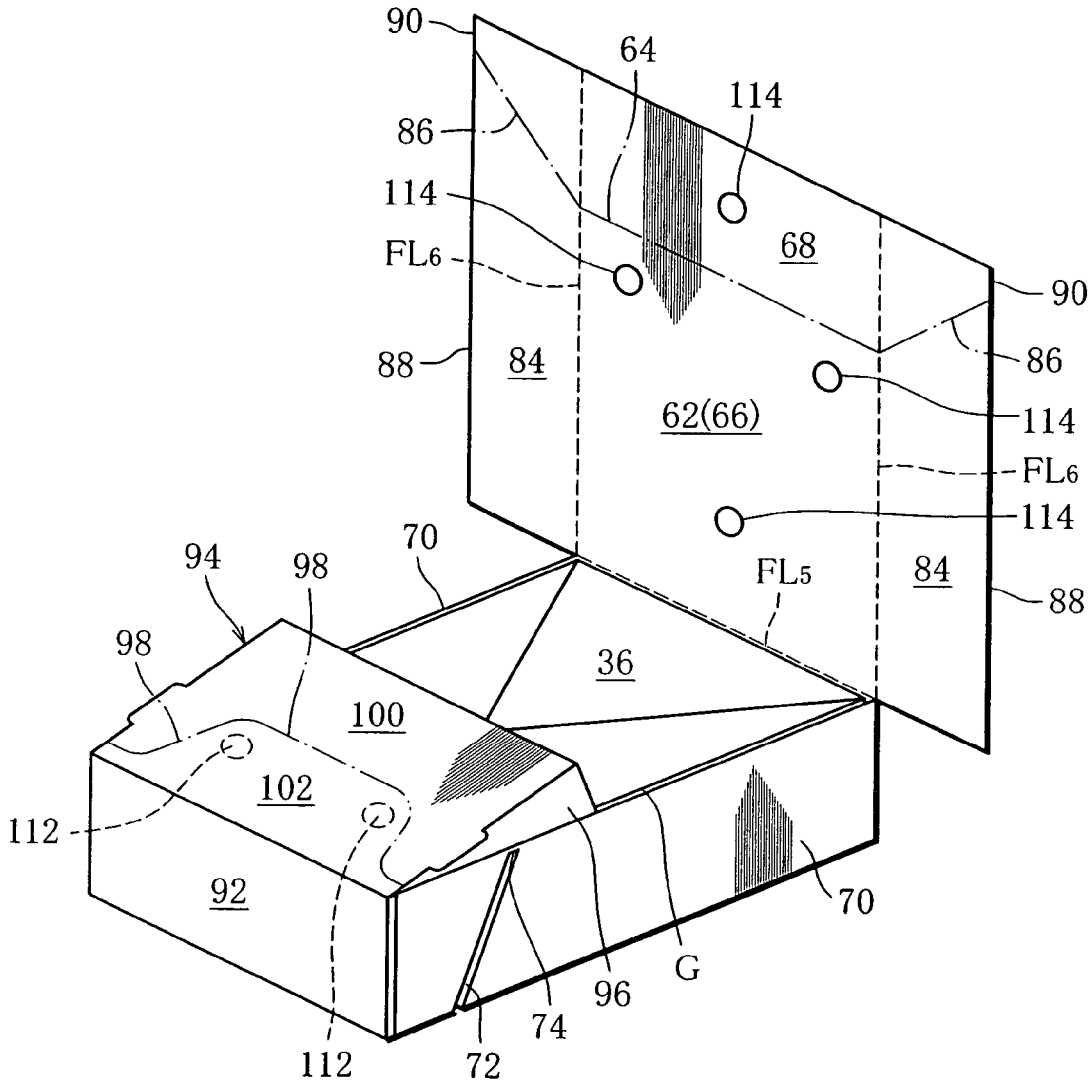
FIG. 9 is a view showing a subsequent folding process of the blank, which continues from the folded state illustrated in FIG. 7.

Subsequently, the inner frame panel 94 is folded along the folding line $FL_4$ and superimposed on the front face of the inner pack 30. Simultaneously with the folding of the inner frame panel 94, each of the frame side flaps 96 is inserted in the gap G between the inner pack 36 and the inner side flap 70 as illustrated in FIG. 9, thereby being sandwiched between the inner pack 36 and the inner side flap 70. Since the insertion wedge 110 forming the gap G is made in the outer surface of the rear guide portion 108, the insertion wedge 110 never hinders the insertion of the frame side flap 96. The insertion wedge 110 is then pulled out from between the inner pack 36 and the inner side flap 70 in response to the rotation of the folding guide 104.

When the inner frame panel 94 is superimposed on the front face of the inner pack 30, the cut-off section 102 of the inner frame panel 94 is adhered to the cut-off section 48 of the inner pack 36 (inner wrapper 38) with the adhesive agent. In FIG. 9, circles 112 shown by broken lines indicate application positions of the adhesive agent applied onto the reverse face of the cut-off section 102.

In the next step, the front panel 62 is folded along the folding line $FL_5$ and superimposed on both the inner frame panel 94 and the inner pack 30. At this point, the front panel section 68 of the front panel 62 is glued to the cut-off section 102 of the inner frame panel 94 with the adhesive agent. The front panel section 68 and the cut-off section 102 then form the front wall 26 (see FIG. 1) of the lid 12. On the other hand, the front panel section 66 of the front panel 62 is adhered to the frame front section 100 of the inner frame panel 94 and the front face of the inner pack 36 with the adhesive agent, to thereby form the front wall 18 of the outer body 10. In FIG. 9, circles 114 shown by solid lines denote application positions of the adhesive agent applied to the reverse faces of the front panel sections 66, 68.

Figure 10:
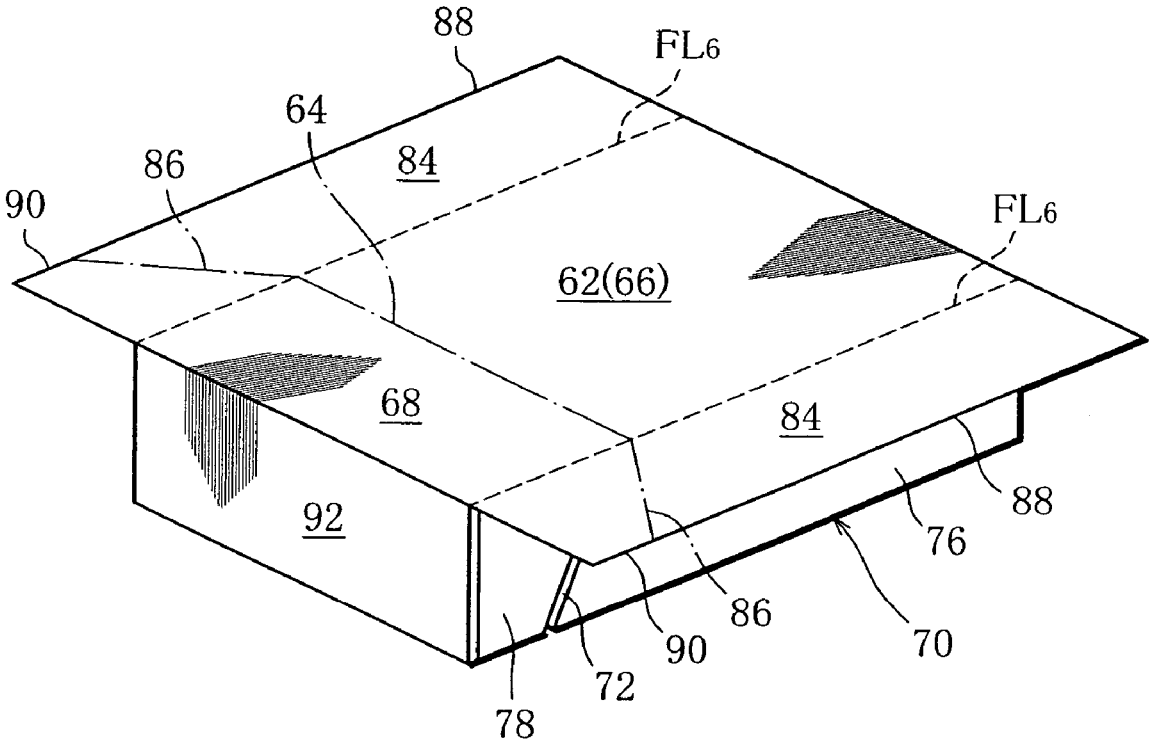
FIG. 10 is a view showing a subsequent folding process of the blank, which continues from the folded state illustrated in FIG. 9.

When the front panel 62 is folded as illustrated in FIG. 10, the outer side flaps 84 provided on respective sides of the front panel 62 protrude from the inner pack 36, namely the corresponding inner side flaps 70 in the width direction of the inner pack 36.

Thereafter, the outer side flaps 84 are folded along the folding lines $FL_6$ toward the respective inner side flaps 70 to be superimposed on the inner side flaps 70. The flap sections 88, 90 of the outer side flaps 84 are superimposed on the flap sections 76, 78 of the inner side flaps 70, respectively, and adhered to each other with the adhesive agent in a state where the row of perforations 86 of the outer side flaps 84 coincide with the respective slots 72 of the inner side flaps 70. As a result, the flap sections 76, 88 form the side walls 20 of the outer body 10, and the flap sections 78, 90 form the side walls 28 of the lid 12. At this stage, the assembly of the package shown in FIG. 1 is completed.

The package shown in FIG. 1 is in a state where the lid 12 is closed. In other words, the outer body 10 and the lid 12 are connected to each other across the separating line 14, and at the same time the lid 12 is connected to the outer body 10 through the inner frame panel 94 (see FIG. 9). When the separating line 14 is broken from the outside of the package, however, the lid 12 becomes rotatable around the self hinge 16.

When the lid 12 is rotated in an opening direction for the first time, the fragile portions 74 of the inner side frames 70 are first broken, and each of the inner side frames 70 is completely separated by the corresponding slot 72 into the flap sections 76, 78. Since the slots 72 extend to both sides of the self hinge 16 as mentioned, the lid 12 can be easily rotated around the self hinge 16.

As described, the frame front section 100 of the inner frame panel 94 is adhered to the front wall 18 (front panel section 66) of the outer body 10, whereas the cut-off section 102 of the inner frame panel 94 is adhered to the front wall 26 (front panel section 68) of the lid 12 (see FIG. 9). As a consequence, when the lid 12 is further rotated, the separating line 98 for marking off the frame front section 100 and the cut-off section 102 is broken. To be short, the inner frame panel 94 is divided into the frame front section 100 and the cut-off section 102. At this point, the lid 12 is completely detached from the outer body 10.

Figure 11:
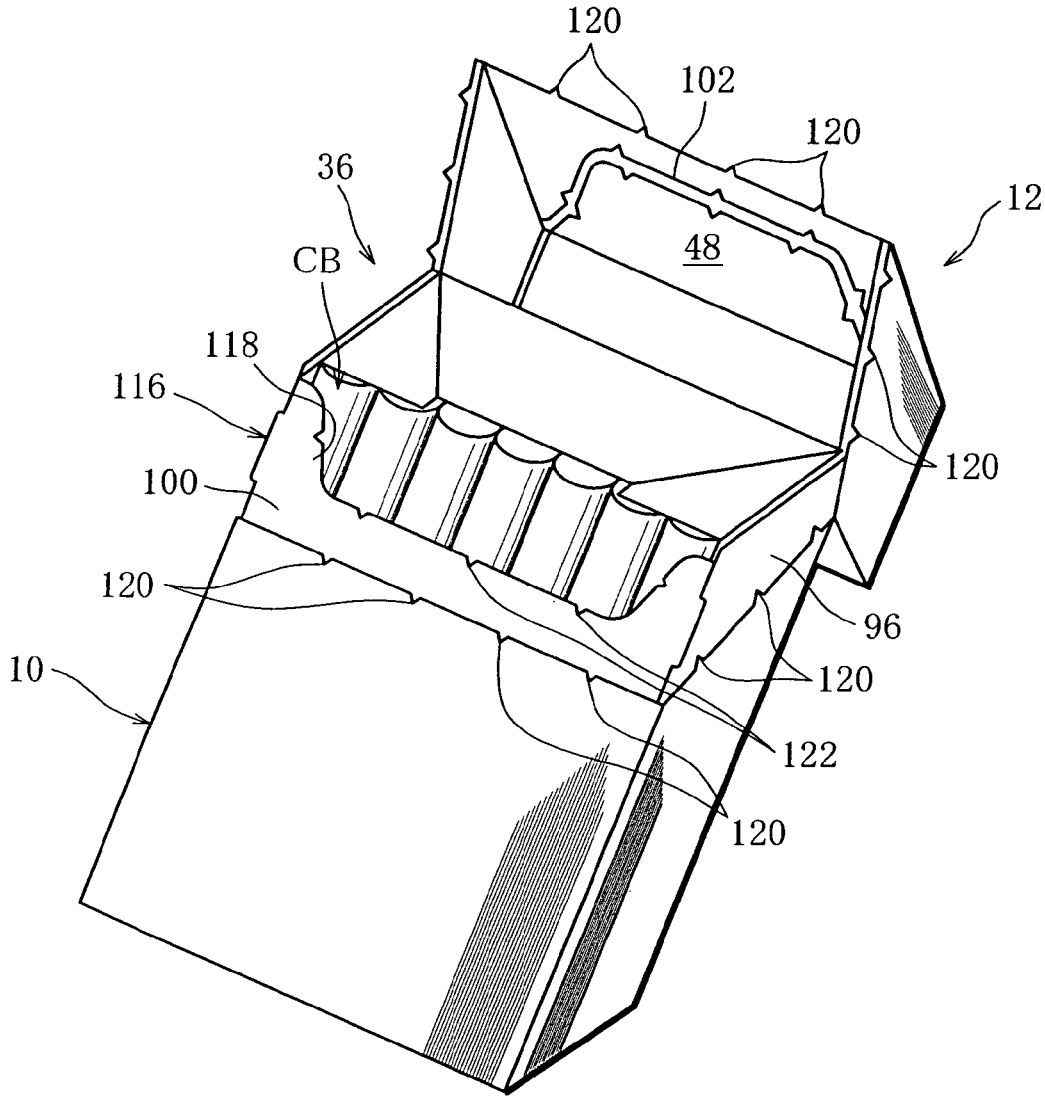
FIG. 11 is a perspective view showing an open state of the package of FIG. 1.

Accordingly, when the lid 12 is fully opened as illustrated in FIG. 11, the frame front section 100 remains in the outer body 10 with the frame side flaps 96. The section 100 and the flaps 96 form an inner frame 116 in the outer body 10. The inner frame 116 protrudes from an opening end of the outer body 10, thereby reinforcing the opening end and serving as a guide for guiding the opening and closing of the lid 12. Moreover, the inner frame 116 has a U-shaped notch 118 in the front wall 18 side of the outer body 10. The notch 118 is made by separating the cut-off section 102 from the frame front section 100. The cut-off section 102 is kept adhered to the front panel section 68, to thereby form the front wall 28 of the lid 12 with the section 68 as described above.

On the other hand, the cut-off section 102 is glued to the cut-off section 48 of the inner pack 36 (inner wrapper 38). Furthermore, the closing flaps 44 of the cut-off section 48 are bonded to the inner top flaps 82 of the lid 12. For this reason, when the lid 12 is opened, the separating line 46 (see FIG. 2) that defines the cut-off section 48 is simultaneously broken. As a result, the cut-off section 48 is separated from a remaining portion of the inner wrapper 38 and removed from the inner pack 36.

Consequently, as is obvious from FIG. 11, upon the opening of the lid 12, the cut-off section 48 is glued to an inner face (cut-off section 102) of the lid 12, and a part of the cigarette bundle CB in the inner pack 36 is exposed through the notch 118 of the inner frame 116.

When the lid 12 is opened in the above-mentioned manner, breaking traces 120 attributable to the breaking of the separating line 14 are left in both the outer body 10 and the lid 12. Thereafter, even if the lid 12 is closed, the breaking traces 120 are clearly visible from the outside of the package, thereby effectively functioning as a countermeasure against tampering on the cigarette bundle CB.

Therefore, the package of the present invention does not require the film wrapper, which prevents the over-wrapping of cigarette bundle CB. Moreover, there is no need for equipment for the film wrapper at the time of manufacturing the packages of the invention, so that the packages can be produced at low cost. Since the film wrapper with a tear tape is not necessary, the package of this invention never incurs the above-mentioned trouble attributable to the pull end of the tear tape at the time of dispensing the package from a vending machine.

Before the lid 12 of the package is opened, a front surface, both side surfaces and a rear surface of the package are made up of the front panel 62, the outer side flaps 84 and the rear panel 52 of the blank 50, respectively, and all of them are flat. Therefore in a case that the package of the present invention is dispensed from a vending machine, an outer surface of the package does not get caught in the dispensing process of the vending machine, which enables the secure and stable dispensing of the package from the vending machine.

When the lid 12 is opened for the first time, the cut-off section 48 of the inner pack 36 is automatically removed, so that the user does not have to get rid of the cut-off section 48. Moreover, since the cut-off section 48 is adhered to the inner face of the lid 12 through the cut-off section 102, the user need not discard the cut-off section 48 separately from the package.

According to the package of the present embodiment, the outer body 10 and the lid 12 are formed from the blank 50 as one sheet together with the inner frame 116. Thus the packaging equipment of the package needs to include a supply path of the blank 50 only, which makes simple the packaging equipment for the package.

As is clear from FIG. 3, the blank 50 essentially has a rectangular outer shape, and there is no need to form a dove tail in the front panel 62. This prevents the production of scraps due to the stamping of dove tails and makes it possible to effectively use a web for forming the blank 50.

In a case that the inner frame 116 is printed, the print can be carried out in parallel with the print for the outer body 10 and the lid 12. This facilitates a printing process for the package.

The present invention is not limited to the package of the first embodiment, and may be modified in various ways.

Figure 12:
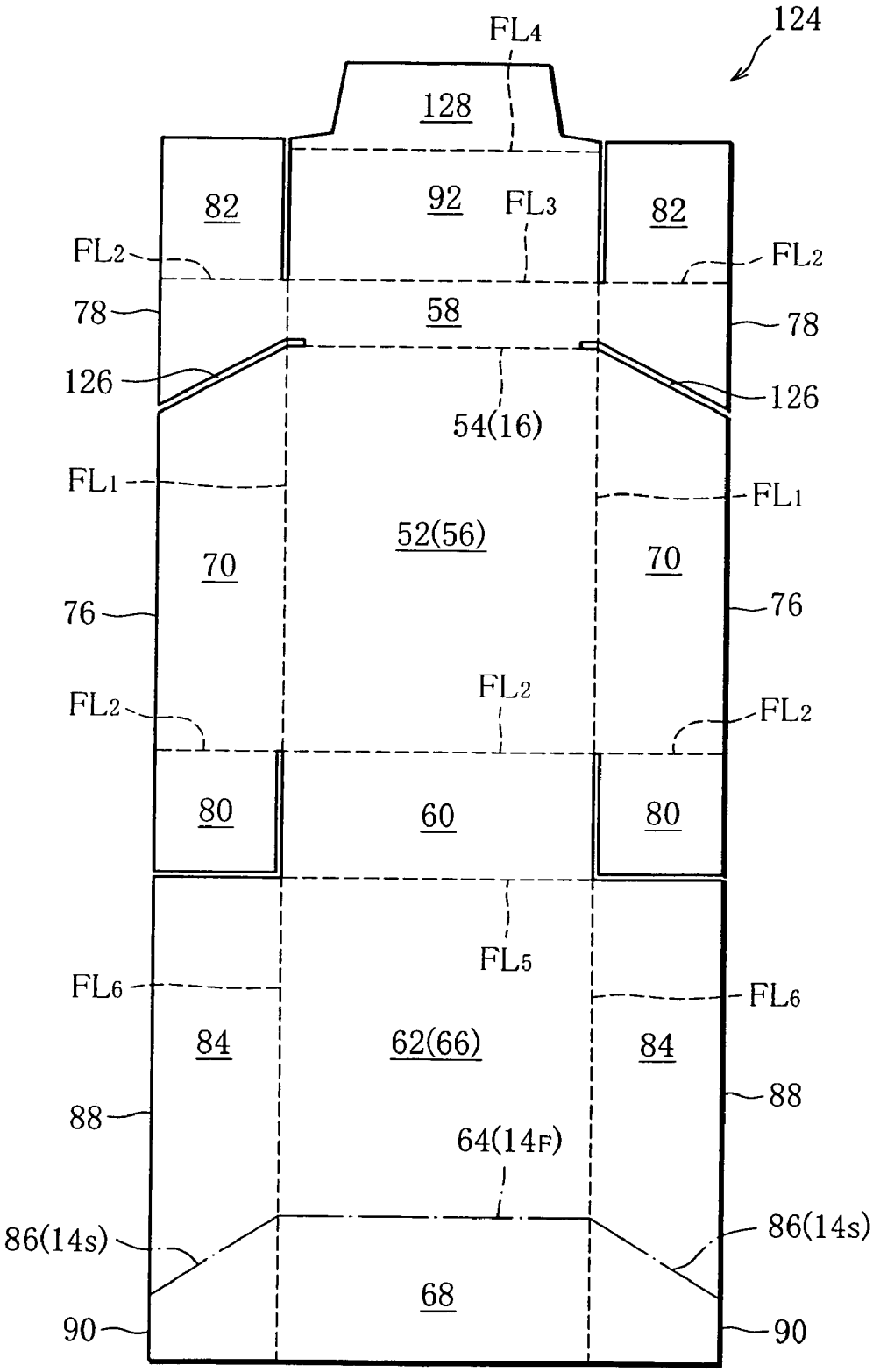
FIG. 12 is a view showing a blank for producing a package of a second embodiment.

For instance, FIG. 12 shows a blank 124 for a package of a second embodiment.

The blank 124 has panels and flaps similar to those of the blank 50 of the first embodiment in order to form the outer body 10 and the lid 12. To avoid the repetition of explanations, the panels and flaps of the blank 124 in FIG. 12, which correspond to those of the blank 50, are provided with identical reference marks.

The blank 124 differs from the blank 50 in the following points.

The blank 124 has slots 126 in place of the slots 72 of the blank 50, and the slots 126 extend up to the outer edges of the inner side flaps 70. In other words, the inner side flaps 70 are preliminarily divided by the slots 126 into the flap sections 76, 78.

Connected to the top panel 92 of the blank 124 across the folding line $FL_4$ is an inner top flap 128. The inner top flap 128 corresponds to the cut-off section 102 of the blank 50 and has the same shape as the cut-off section 102.

Figure 13:
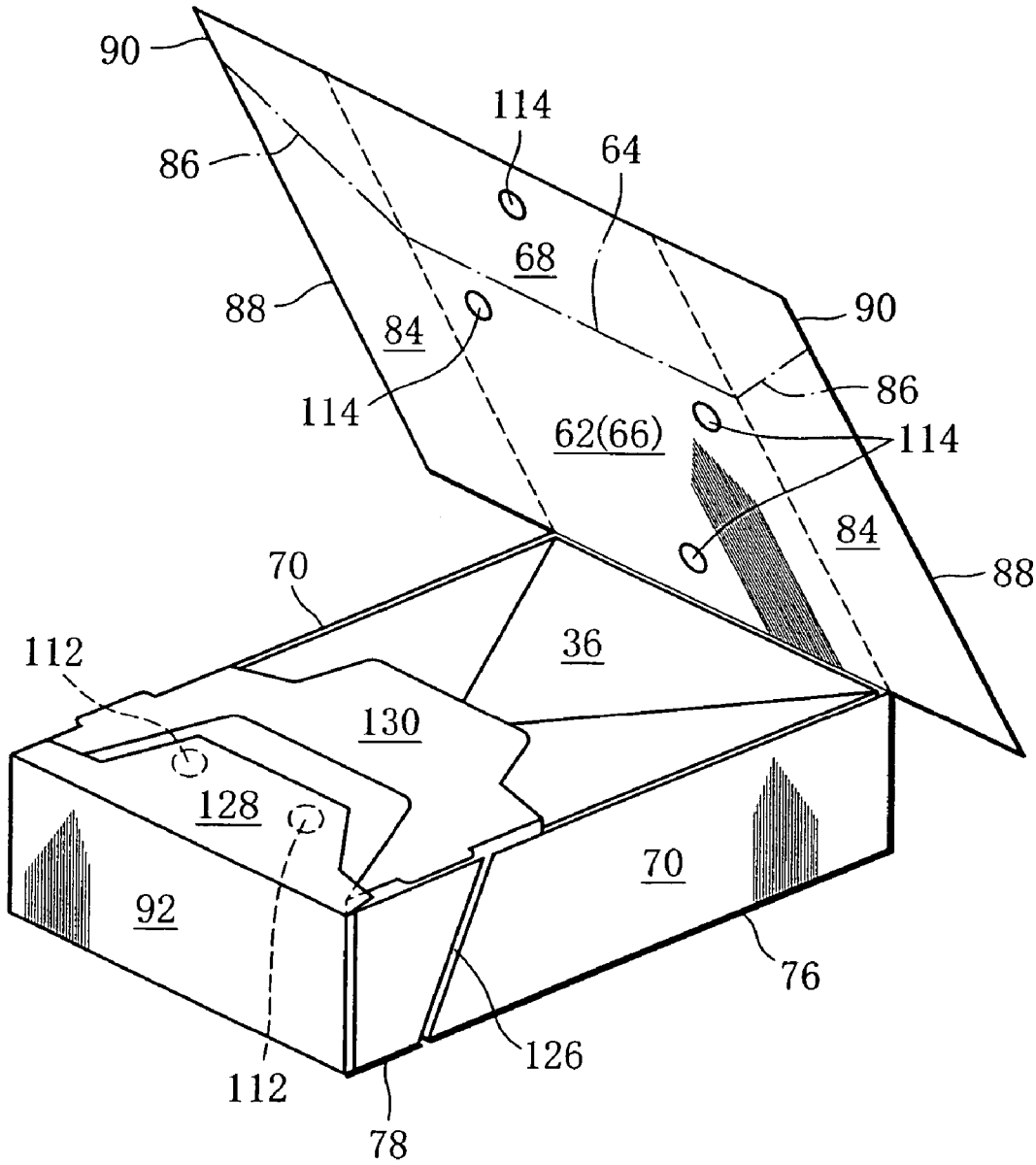
FIG. 13 is a perspective view showing a folding process of the blank of FIG. 12 corresponding to the folded state illustrated in FIG. 9.

In the case where the package is formed from the blank 124, the inner pack 36 is beforehand provided with an inner frame 130 as illustrated in FIG. 13. The inner frame 130 is shaped similarly to the inner frame 116. More specifically, the inner frame 130 is made up of another sub blank. The sub blank has a section and flaps that are identical to the frame front section 100 and the frame side flaps 96 of the blank 50. The inner frame 130 is formed by superimposing the frame front section of the sub blank on the front face of the inner pack 36 and then folding the frame side flaps of the sub blank with respect to the corresponding side faces of the inner pack 36.

After the inner pack 36 with the inner frame 130 is supplied onto a reverse face of the blank 124, the blank 124 is folded in the folding steps similar to the blank 50, to thereby assemble the package.

In this case, the blank 124 does not include frame side flaps, so that there is no need for the folding guide 114 at the time of folding the inner top flap 128. The flap sections 76 of the inner side flaps 70 are glued to the inner frame 130, and the inner top flap 128 to the cut-off section 48 of inner pack 36.

The package formed from the blank 124 has the same appearance as the package shown in FIG. 1 and does not require the film wrapping.

Each of the packages mentioned above has four sharp side corners that extend between the bottom wall 24 of the outer body 10 and the top wall 32 of the lid 12. The package of the invention, however, may have round side corners instead of having the sharp side corners.

The invention claimed is:

1. A hinge-lid type package without a film wrapper for rod-like smoking articles, comprising:

an inner pack having an inner wrapper in which a bundle of the rod-like smoking articles is wrapped; and a rectangular parallelepiped casing for accommodating said inner pack, wherein said casing includes:

a front wall, a rear wall, two side walls, a bottom wall, a top wall, a hinge formed in an upper portion of said rear wall, extending across said rear wall and having both ends, a first separating line extending across said front wall and said both side walls and connecting said both ends of said hinge, said first separating line which allows said casing to be divided into an outer body and a lid that is rotatable around said hinge, and an inner frame disposed in the inside of said outer body and guides opening and closing of said lid, the inner frame having a top panel connected to the upper portion of the rear wall, wherein said both side walls each have an inner side wall layer and an outer side wall layer;

said first separating line includes a front portion formed in said front wall and a side portion formed in each of said side walls; and said side portion includes a slot that is formed in said inner side wall layer and divides said inner side wall and a row of perforations formed in said outer side wall layer and overlapping with said slot, wherein the front portion of said first separating line formed as a row of perforations, and wherein the inner frame is formed with a cut-off section demarcated by a second separating line, and when the lid is opened for a first time, the cut-off section is separated along the second separating line, thus forming an access opening in a shape of a U-shaped notch in the inner frame, and separated cut-off section is held on an inner surface of the lid.

2. The package according to claim 1, wherein:

said inner frame is separated from said front wall.

3. The package according to claim 1, wherein the slot is formed with a fragile portion left, and a side perforation row formed in said outer side wall layer and superimposed on said slot.

4. The package according to claim 3, wherein:

said front wall includes a portion for forming said lid, said portion has an inner front wall layer and an outer front wall layer; and said first separating line further includes a frame perforation row for connecting between said inner frame and said inner front wall layer before said lid is opened for the first time, and the inner frame is detached from said inner front wall layer along said frame perforation row when said lid is opened for the first time.

5. The package according to claim 1, wherein a top panel of the inner frame is connected to the upper portion of the rear wall.

6. A blank for producing a hinge-lid type package without a film wrapper for rod-like smoking articles, comprising:

a rectangular rear panel having an upper edge, both side edges, a lower edge, and a folding line for forming a hinge;

a bottom panel connected to the lower edge of said rear panel with the lower edge used as a folding line and having a lower edge on the opposite side of said rear panel;

a front panel connected to the lower edge of said bottom panel with the lower edge used as a folding line, having both side edges, and having the same size as said rear panel;

two inner side flaps connected to the respective side edges of said rear panel with both the side edges used as folding lines and having the same length as said rear panel;

two outer side flaps connected to the respective side edges of said front panel with both the side edges used as folding lines and having the same length as said front panel;

a top panel connected to the upper edge of said rear panel with the upper edge used as a folding line and having an upper edge;

an inner top flap connected to the upper edge of said top panel with the upper edge used as a folding line; and a first separating line formed in said front panel, and said inner and outer side flaps, for dividing said package into an outer body and a lid that is turnable around said hinge after said package is formed from said blank, wherein:

said first separating line includes:

a front portion formed in said front panel;

a side portion formed in each of said outer side flaps; and a slot formed in each of said inner side flaps, for dividing said corresponding inner side flap; and a row of perforations formed in each of said outer side flaps so that the row of perforations is overlapped with said corresponding slot when the package is formed, the blank further comprising:

a sub blank connected to said inner top flap across a frame perforation row, for forming an inner frame in the inside of said package, wherein the inner frame is formed with a cut-off section demarcated by a second separating line, and when the lid is opened for a first time, the cut-off section is separated along the second separating line, thus forming an access opening in a shape of a U-shaped notch in the inner frame, and separated cut-off section is held on an inner surface of the lid.

7. The blank according to claim 6, wherein:

said slots extend from said rear panel up to outer edges of said inner side flaps.

8. The blank according to claim 6, wherein:

said slots extend from said rear panel up to the vicinity of outer edges of said inner side flaps with fragile portions left in between the slots and the respective outer edges of said inner side flaps.

* * * * *